US008454310B1

(12) United States Patent
Downs

(10) Patent No.: US 8,454,310 B1
(45) Date of Patent: Jun. 4, 2013

(54) COMPRESSOR BLADE WITH TIP SEALING

(75) Inventor: James P Downs, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 897 days.

(21) Appl. No.: 12/506,577

(22) Filed: Jul. 21, 2009

(51) Int. Cl.
*F01D 5/20* (2006.01)

(52) U.S. Cl.
USPC ..... 416/1; 416/91; 416/92; 416/97 R; 416/231 R; 416/231 B

(58) Field of Classification Search
USPC ..... 416/90 R, 90 A, 91, 92, 97 R, 231 B, 416/231 R, 1
See application file for complete search history.

(56) References Cited

U.S. PATENT DOCUMENTS

| | | | | |
|---|---|---|---|---|
| 4,390,320 | A | 6/1983 | Eiswerth | |
| 5,282,721 | A | 2/1994 | Kildea | |
| 5,403,158 | A | 4/1995 | Auxier | |
| 5,480,284 | A * | 1/1996 | Wadia et al. | 416/91 |
| 5,688,107 | A | 11/1997 | Downs et al. | |
| 6,086,328 | A | 7/2000 | Lee | |
| 6,494,678 | B1 | 12/2002 | Bunker | |
| 6,602,052 | B2 | 8/2003 | Liang | |
| 7,287,959 | B2 | 10/2007 | Lee et al. | |
| 7,320,575 | B2 * | 1/2008 | Wadia et al. | 416/97 R |
| 2007/0077143 | A1 * | 4/2007 | Sherlock et al. | 416/92 |

* cited by examiner

*Primary Examiner* — Edward Look
*Assistant Examiner* — Jason Davis
(74) *Attorney, Agent, or Firm* — John Ryznic

(57) ABSTRACT

An axial flow compressor blade with a cavity formed within the blade tip region and connected by an array of holes onto the pressure side surface of the blade in the tip region so that compressed gas will flow into the cavity, and the cavity is connected by a row of tip slots arranged along the blade tip along the pressure side tip corner to discharge the compressed gas from within the cavity out onto the blade tip toward the oncoming compressed gas flow over the blade tip to reduce or eliminate any boundary layer formation and to reduce blade tip leakage flow.

10 Claims, 1 Drawing Sheet

COMPRESSOR BLADE WITH TIP SEALING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a turbo-machine, and more specifically to an axial flow compressor with a rotor blade having boundary layer control.

2. Description of the Related Art Including Information Disclosed Under 37 CFR 1.97 and 1.98

In a turbo-machine, such as an axial flow compressor in a gas turbine engine, a compressor includes a row of rotor blades that compress the air or other compressible fluid. The rotor blades include a blade tip that forms a gas seal with an inner surface of a stationary shroud or casing of the turbo-machinery. A compressor blade will form a boundary layer on its surface from the compressed gas as the gas flows over the blade surface. The boundary layer is a low velocity gas on the airfoil surface that will lower the performance of the blade.

BRIEF SUMMARY OF THE INVENTION

It is an object of the present invention to provide for an axial flow compressor with a rotor blade in which the boundary layer formed on the airfoil surface is significantly reduced or eliminated.

It is another object of the present invention to provide for an axial flow compressor with a rotor blade that has improved tip sealing capability.

These objectives and more are achieved in the axial flow compressor with rotor blades in which the blade tip section includes a cavity connected by an array of holes that open onto the pressure side surface of the blade to deliver gas to the cavity, and a row of blade tip holes that connect the cavity and open onto the blade tip and extend along the pressure side wall of the blade tip to discharge the air (or gas) from the cavity in a direction toward an oncoming gas flow over the blade tip. Rotation of the blade forces some of the compressed gas on the pressure side wall of the blade into the cavity and then out through the blade tip holes to reduce or eliminate the boundary layer developed around this region of the blade, and to provide for a gas flow to block oncoming compressed gases and prevent or reduce leakage across the blade tip gap.

DETAILED DESCRIPTION OF THE INVENTION

Figure 1:
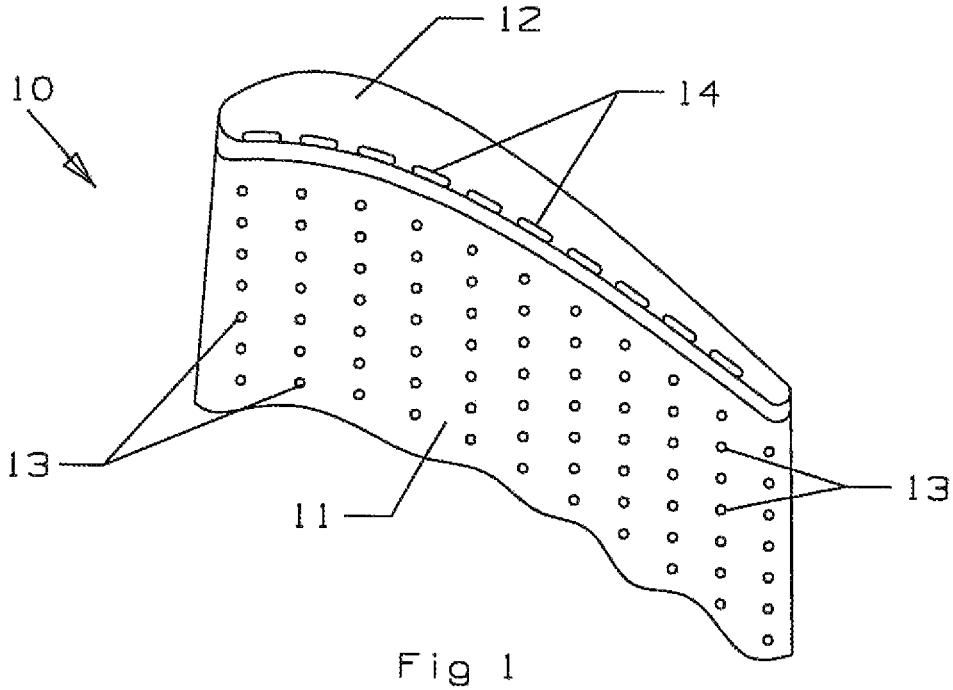
FIG. 1 shows an isometric view of a blade tip region of an axial flow compressor blade of the present invention on the pressure side of the blade.

The present invention is intended for a rotor blade in an axial flow compressor, but can also be used in a turbine rotor blade as well if the blade tip region of the blade with the cavity and the pressure side holes and blade tip holes can be included without requiring additional cooling passages for the turbine blade to provide needed cooling for the blade tip region of the turbine blade. FIG. 1 shows the compressor blade 10 of the present invention from the pressure wall side and from the top. The blade 10 includes a pressure sidewall or surface 11 and a blade tip 12. The pressure side wall 11 in the tip region includes an array of holes 13 that open onto the pressure side wall of the blade. The blade tip includes a row of slots 14 that extend along the blade tip adjacent to the pressure sidewall edge and open onto the blade tip. The slots 14 are wide compared to the depth in order to discharge pressurized gas from within the blade tip region and out toward the oncoming compressed gas flowing over the blade tip as is described below.

Figure 2:
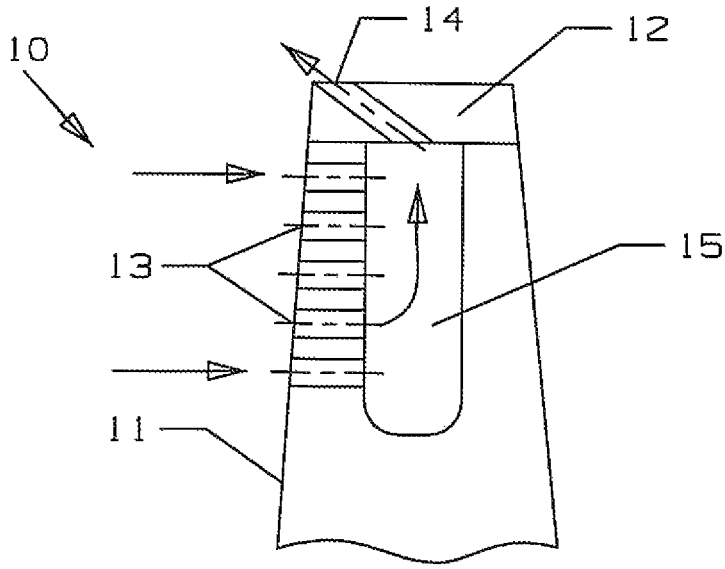
FIG. 2 shows a cross section view through the blade tip region of the compressor blade of FIG. 1.

FIG. 2 shows the blade tip region to include an inner cavity 15 in which the pressure sidewall holes 13 and the row of blade tip slots 14 are connected to. The blade tip cavity 15 extends along the chord wise length of the blade tip region from the leading edge to the trailing edge. Any well-known bonding or brazing process to enclose the cavity 15 and form the blade tip for the blade 10 secures a blade tip 12. In another embodiment, the blade tip can be formed integral as a single piece with the airfoil section of the blade using any well-known process such as the investment casting process. The cavity 15 should extend from the leading edge to the trailing edge of the blade so that the inlet holes leading into the cavity can be opened onto the entire surface on which the compressed gas is formed, and so that gases can be discharged onto the blade tip from as close to the leading edge and the trailing edge as possible in order to provide as much of the chord wise length of the blade tip as possible with compressed gas to block any leakage flow across the blade tip. Also, the cavity 15 can be formed as separated and distinct cavities if so warranted. The blade tip holes 14 are wide and narrow in the direction from pressure side wall to suction side wall in order to cover as much of the blade tip periphery as possible yet not be too open on the blade tip surface such that the tip leakage flow will flow into the clearance gap formed between the moving blade tip and stationary outer shroud.

The array of holes 13 on the pressure sidewall in the tip region is arranged around this surface so that the compressed gas forming on this surface will flow through the holes and into the cavity 15. The size and spacing of the pressure sidewall holes 13 will depend upon the size of the blade and the composition of the compressible fluid that the blade is compressing in the turbo-machine. Also, the depth of the pressure wall side holes 13 will depend upon the diameter of each of the holes 13 and the amount of gas required to pass into the cavity 15. The blade tip holes 14 are connected to the cavity 15 and are slanted toward the pressure side wall (as opposed to the suction side wall) to block the oncoming compressed air that can pass over the blade tip and through the tip gap formed with the stationary outer shroud or blade outer air seal (BOAS). The pressurized gas discharged from the cavity through the tip holes 14 will restrict and counter the leakage of gas from the pressure side to the suction side of the blade to improve the performance of the compressor.

The cavity 15 and tip holes 14 will be charged with compressed gas from the rotation of the rotor blade 10 by allowing some of the compressed gas forming on the pressure side wall to pass through the pressure side wall holes 13 and into the cavity. The discharge pressure of tip holes 14 will be substantially lower due to acceleration of the gas flow into the clearance gap formed between the moving blade tip and stationary outer shroud. The pressure side wall holes 13 and tip holes 14 are relatively sized to maintain the pressure in cavity 15 at some desired intermediate pressure between that of the pressure side and the clearance gap. Rotation of the blade will also force the air within the cavity out through the tip holes due to high centrifugal forces developed during the blade rotation.

The blade tip with the holes 13 and 14 and cavity 15 can be used in a turbine rotor blade for the same reasons as in the compressor blade if the turbine blade does not require cooling, or if it can still be cooled in the blade tip region. Since the turbine rotor blade is typically exposed to a higher gas flow temperature than in a compressor blade, high levels of cooling might be required in the turbine blade, especially in the tip region. Later stages of turbine blade would be more acceptable for using the boundary layer control structure of the present invention because the environmental heat load is lower. First and maybe second stage turbine rotor blades of modern turbo machines are typically exposed to too high of a gas flow temperature to allow for the cavity to be filled with the hot gas flow acting on the pressure side wall surface of the rotor blade to be passed into the cavity and then through the tip holes.

I claim the following:

1. An axial flow compressor blade comprising:

a pressure side wall;

a blade tip;

a blade tip region cavity formed within the blade tip region of the compressor blade and extending from a leading edge region to a trailing edge region of the blade;

a plurality of holes opening onto the pressure side wall of the blade in the blade tip region and connected to the blade tip region cavity; and, a row of blade tip slots connected to the blade tip region cavity and opening onto the blade tip surface and slanted toward the pressure side wall such that compressed gas forming on the pressure side wall of the compressor blade will flow into the blade tip region cavity and then out through the blade tip slots to reduce boundary layer build-up and reduce blade tip leakage flow.

2. The axial flow compressor blade of claim 1, and further comprising:

the blade tip region cavity extends from a leading edge region of the blade tip to a trailing edge region of the blade tip.

3. The axial flow compressor blade of claim 2, and further comprising:

the blade tip region cavity is a single cavity.

4. The axial flow compressor blade of claim 1, and further comprising:

the row of blade tip slots opens onto the blade tip adjacent to the pressure side wall tip corner.

5. The axial flow compressor blade of claim 1, and further comprising:

the plurality of holes opening onto the pressure side wall of the blade forms an array of holes that extend from the leading edge region to the trailing edge region of the blade.

6. The axial flow compressor blade of claim 5, and further comprising:

the array of holes on the pressure side wall extends from the pressure side tip corner.

7. The axial flow compressor blade of claim 1, and further comprising:

the blade tip region cavity is enclosed by a blade tip formed as a separate piece to the airfoil section of the blade with the blade tip bonded to the airfoil section.

8. A process for reducing a boundary layer formation on an axial flow compressor blade and for reducing a leakage flow across a blade tip gap, the process comprising the steps of:

passing some of the compressed gas forming over the pressure side wall of the blade in the tip region into an enclosed cavity formed within the blade tip region of the blade; and, discharging the gas from within the enclosed cavity out from the blade tip along the pressure side corner in a direction slanted toward the pressure side wall to reduce blade tip leakage flow.

9. The process for reducing a boundary layer formation on an axial flow compressor blade of claim 8, and further comprising the step of:

discharging the gas from the enclosed cavity along the entire pressure side tip periphery of the blade tip corner from the leading edge to the trailing edge of the blade tip.

10. The process for reducing a boundary layer formation on an axial flow compressor blade of claim 8, and further comprising the step of:

passing the compressed gas into the enclosed cavity from the entire pressure side tip region of the blade from the leading edge to the trailing edge regions of the blade tip region.

* * * * *